US006494012B2

(12) United States Patent
Seng

(10) Patent No.: US 6,494,012 B2
(45) **Date of Patent: *Dec. 17, 2002**

(54) ACOUSTICAL COMPOSITE STEEL MEMBER

(75) Inventor: Stephen Seng, Howard, OH (US)

(73) Assignee: East Ohio Machinery Company, Newark, OH (US)

( * ) Notice: Subject to any disclaimer, the term of this patent is extended or adjusted under 35 U.S.C. 154(b) by 39 days.

This patent is subject to a terminal disclaimer.

(21) Appl. No.: 09/734,493

(22) Filed: Dec. 11, 2000

(65) Prior Publication Data

US 2001/0037621 A1 Nov. 8, 2001

Related U.S. Application Data

(63) Continuation-in-part of application No. 09/280,338, filed on Mar. 29, 1999, now Pat. No. 6,158,190.

(51) Int. Cl.[7] ..... E04C 3/32; E04C 3/36

(52) U.S. Cl. ..... 52/731.5; 52/309.4; 52/309.9; 52/309.14; 52/406.2; 52/730.1; 52/731.2; 52/737.4; 52/404.1

(58) Field of Search ..... 52/731.5, 730.1, 52/731.2, 737.4, 309.1, 309.4, 309.9, 309.14, 404.1, 406.2

(56) References Cited

U.S. PATENT DOCUMENTS

| | | | | | |
|---|---|---|---|---|---|
| 4,713,921 | A | * | 12/1987 | Minialoff et al. | 52/579 |
| 4,795,666 | A | * | 1/1989 | Okada et al. | 428/71 |
| 5,285,615 | A | | 2/1994 | Gilmour | |
| 5,475,961 | A | | 12/1995 | Menchetti | |
| 5,609,006 | A | * | 3/1997 | Boyer | 52/731.9 |
| 5,678,381 | A | * | 10/1997 | DenAdel | 52/730.1 |
| 5,720,144 | A | | 2/1998 | Knudson et al. | |
| 6,158,190 | A | * | 12/2000 | Seng | 52/735.1 |

* cited by examiner

*Primary Examiner*—Yvonne M. Horton
(74) *Attorney, Agent, or Firm*—Emch, Schaffer, Schaub & Porcello Co., L.P.A.

(57) ABSTRACT

This composite building stud combines two metal shapes, inner and outer, with an insulating material to form a composite structural member having excellent acoustical properties. The stud also has an insulating valve (R-value) greater than a similar metal member normally used as a stud in a residential structure. The composite also has a strength comparable to that of a similar steel member normally used as a stud in a residential structure. One shape encompasses the other shape. The composite structural member eliminates any direct metal connections and thus eliminates any thermal shorts that reduce the overall insulating value (R-value) of the composite member.

25 Claims, 4 Drawing Sheets

ACOUSTICAL COMPOSITE STEEL MEMBER

RELATED APPLICATIONS

This patent application is a continuation-in-part of Ser. No. 09/280,338 filed on Mar. 29, 1999 U.S. Pat. No. 6,158,190 issued Dec. 12, 2000.

TECHNICAL FIELD

This invention relates to a composite, structural, steel stud with a thermal break between opposite sides and with excellent acoustical properties.

BACKGROUND ART

The conventional residential building market has revolved around wood frame structures. Wood frame structures have dominated due to the abundance, economics and construction knowledge associated with wood and wood products. Currently, some of the dominating factors of wood frame structures are yielding to other materials. Some of these factors are pricing, quality of material, strength (hurricanes & earthquakes) and durability (termites). Today, the material cost of steel framing is comparable to that of wood. Many steel manufacturers have geared up to deal with an expanding steel frame market by installing new galvanizing plants. Markets have expanded in California's earthquake zones since steel frame buildings can be more durable. Steel frame markets in Florida and Texas have grown to overcome termite and hurricane damage. New construction practices and construction tools have developed, as have building code standards to accept the new boom in steel frame buildings. However, a new setback has surfaced with residential steel frame building: thermal efficiency. Where high thermal efficiencies are required in the cooler climates, conventional steel frame buildings are not thermally equivalent to wood structures.

Steel studs inherently have thermal short problems. Steel studs in frames produce a thermal bridge between opposite sides of a wall frame, joist or truss member. This thermal bridging readily transfers heat across metal members, which results in excessive heating/cooling costs, condensation, and accelerated thermal rot in sheeting materials like drywall and siding. Heat transfer utilizes three basic mechanisms; conduction, radiation and convection. With typical wood framing, the wood itself is an insulator, which eliminates conduction. Effective thermal sheeting and batting insulation prevent radiation across the frame and convection within the dead space. With steel framing, the metal conducts heat across the frame. Sheeting and batting insulation reduce radiation and convection, but can not significantly reduce the thermal shorts of the steel members and their endpoint connections.

In simple words, conventional steel studs conduct cold from the outside wall to the inside wall. In severe cold climates under prolonged use, gray stripes develop on the inside wall. The stripe occurs where the conventional steel stud touches the warm inside wall. Industry has proposed several approaches to providing metal beams with a thermal break between opposite walls. No approach, however, has completely eliminated the thermal short problems associated with metal beams. Nor have these approaches provided a stud with the superior structural properties of steel and the thermal equivalence of wood.

DISCLOSURE OF INVENTION

The composite of this invention has excellent acoustical or sound dampening properties. Steel or metal studs generally are better than wood studs. The composite stud of this invention has acoustical properties better than steel or metal studs. The thermal break eliminates any direct metal connections thereby interrupting the path noise would follow.

The composite of this invention combines two metal shapes, inner and outer, with an insulating material to form a composite structural member having an insulating valve (R Value) greater than a similar steel member normally used as a stud in a residential structure. The R value of the composite member is R-2.5 to R-5 while the R value of the equivalent steel member is R-0.0098 and that of an equivalent wood member is R-2.9 to R-4.9. Thus, the composite steel member has an R value comparable to wood which is three order of magnitude better than that of a equivalent steel member. Also, the composite steel member is three orders of magnitude better than the R value of wood. The composite also has a strength comparable to that of a similar steel member normally used as a stud in a residential structure. The composite structural member eliminates any direct metal connections and thus eliminates any thermal shorts that reduce the overall insulating value (R-Value) of the composite member. The two steel shapes, inner and outer, with an insulating material form a composite structural member that has an interlocking shape which utilizes the compression strength of the insulating material and mechanically couples the inner and outer members. The interlocking shape holds the insulating material in compression and mechanically couples the inner and outer members regardless of whether the inner and outer members are in relative tension loading or compression loading. Coupling the composite structural members together forms thermally independent connections which eliminate thermal shorts between the inner and outer steel shapes. The coupling also eliminates thermal shorts between the inner and outer steel shapes and the floor and wall connections and also eliminates thermal shorts between the inner and outer steel shapes and the truss connection.

In the preferred embodiment, one shape encompasses the other shape. Preferably, an outer C shape encompasses an inner T shape. Insulation material is between the C and the T.

BEST MODE OF CARRYING OUT INVENTION

The composite of this invention can have excellent acoustical or sound dampening properties depending on the selection of the insulating material. Steel studs are generally better than wood studs because they have less mass connecting the inner and outer walls and therefore have less sound transmission. The composite stud of this invention has acoustical properties better than steel or metal studs because of the isolation between the inner and outer frames. The thermal break eliminates any direct metal connections thereby interrupting the path noise energy would follow. Generally, the transmission loss (TL) through a give wall design is a weighted average of all the sound paths through the composite parts of the wall. ASTM has a rating system for comparing wall designs called "sound transmission class" (STC). The STC rating for a double sided gypsum board wall using wood 2 by 4 construction would be in the range of STC=30–36. The same wall using 4'steel studs would be STC–39–40. The composite stud of this invention in the same wall may have a higher transmission loss with a STC of about 42–45. Every 3 STC points is about a 50% reduction in the transmitted noise energy.

In a preferred embodiment, the coupling between the inner and outer steel members and the insulating material uses an adhesive between the two steel members and the insulating material. Another preferred embodiment further improves the coupling between the inner and outer steel members through the insulating material by filling the cavity between the two steel members with a self setting foam that naturally adheres to the steel members. This couples the structural members together to form thermally independent connections which eliminate thermal shorts between the inner and outer steel shapes.

Figure 1:
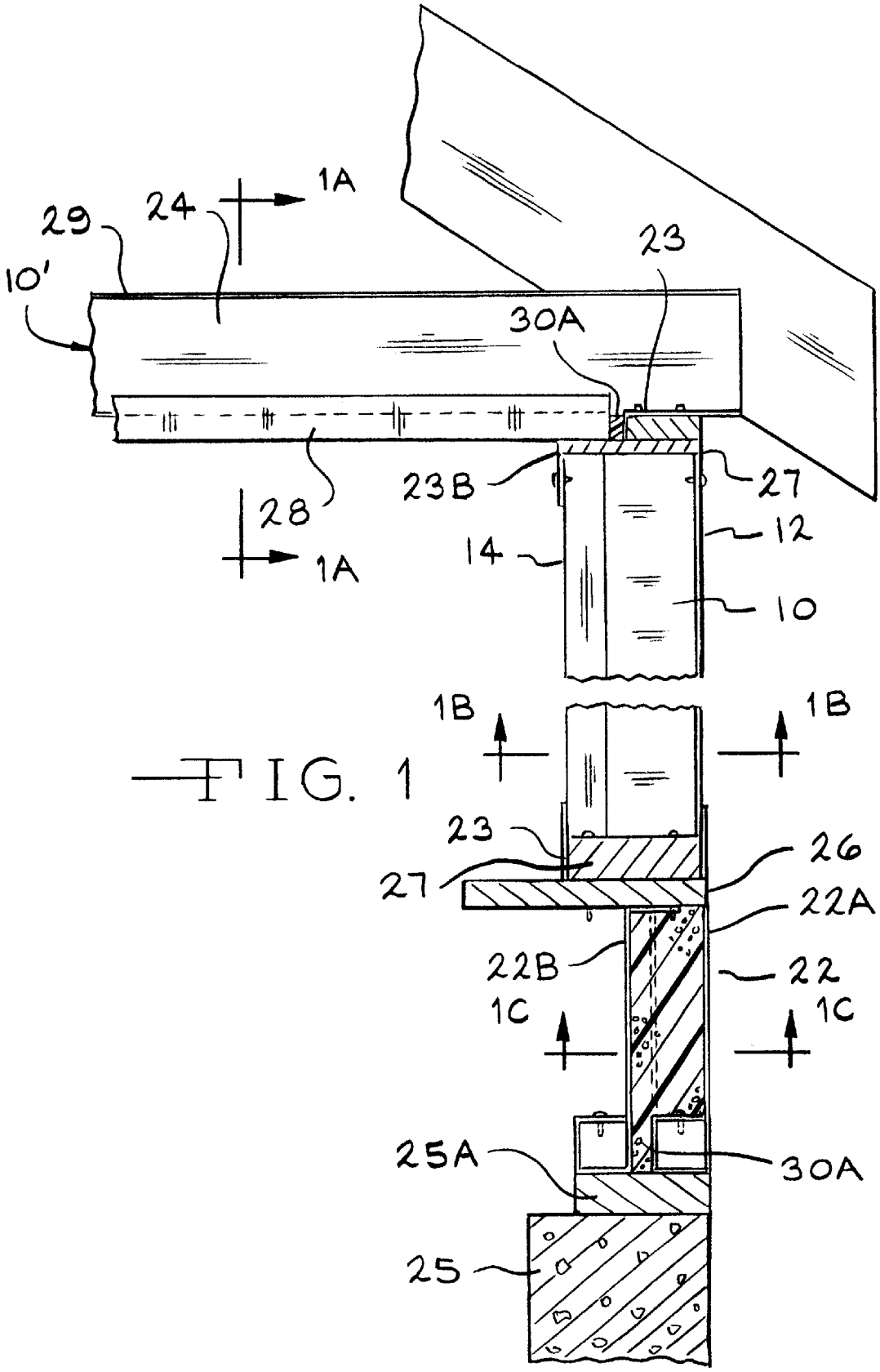
FIG. 1 is partial, sectional perspective view of a building utilizing the composite member of this invention.
Figure 2:
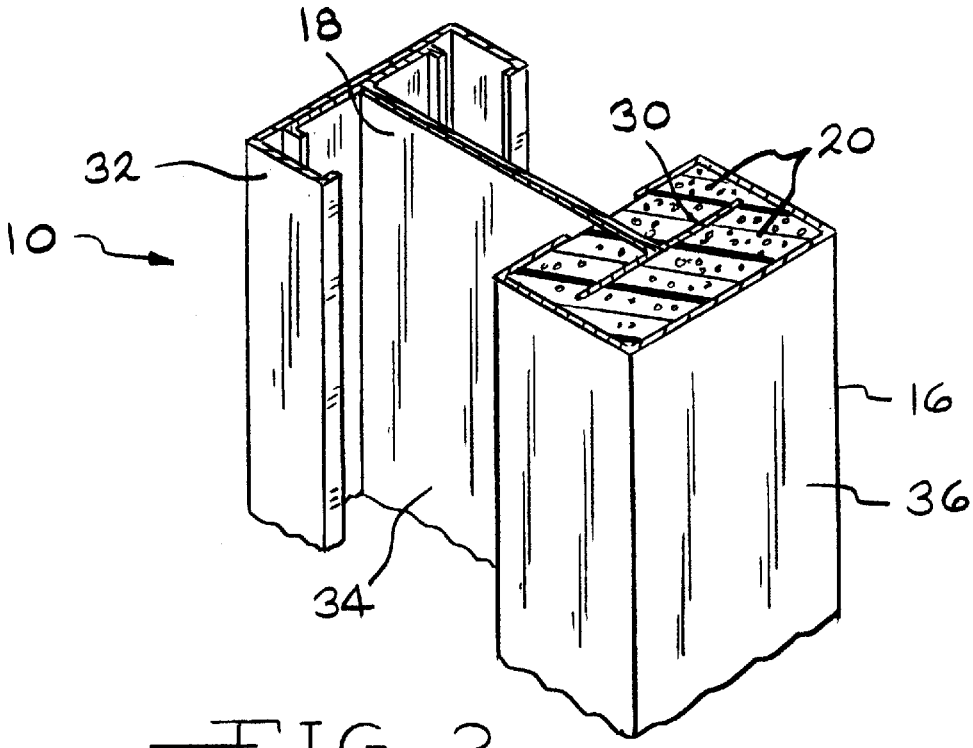
FIG. 2 is a perspective view of a preferred embodiment of the wall stud of this invention.

FIG. 1 shows wall stud 10 framing outside wall 12 and inside wall 14. FIG. 2 shows stud 10 combines two metal shapes, outer shape 16 and inner shape 18 with insulating material 20 to form a composite structural member having an insulating value (R-Value) greater than a similar steel member normally used as a stud in a residential structure. Stud 10 has a strength comparable to a similar steel member normally used as a stud in a residential structure. The buckling and torsional strengths of the composite member is much greater than the conventional C-shape due to the increased section modulus of the T-shape and C-shape. Composite stud 10 eliminates any direct metal connection between outer shape 16 and inner shape 18 while maintaining mechanical coupling through the insulation. This, thus eliminates any thermal shorts between outside wall 12 and inside wall 14. This thermal break also is necessary between studs 10 and foundation 25, ceiling 29, floor 26, truss 10' and stud end point connectors 23.

Likewise thermal breaks must be maintained between all inner and outer frame members and any connection between them. For instance, foundation plate 25A may be an insulating wooden component or an isolated dual steel box arrangement which maintains a thermal break. Further, floor joist outer rail 22A and 22B must maintain a thermal break between them, but also may be mechanically coupled through the use of a horizontal T-shape within a C-shape. Likewise, the stud base angles 23 each separately connect to the inner and outer joist rails 22A & 22B respectively. More difficult in FIG. 1, bottom roof truss chord 10' is separated into T-shape 24 and C-shape 28 to create a thermal break and mechanical coupling. The bottom truss chord 10' must rest on the stud by two independent connections. A direct connection of bottom cord C-shape 28 is made to top stud angle 23B. The other connection is made between bottom chord T-shape 24 to steel box support 23 which has a flange that bolts to 10. The box design has to be sufficient to support the loads from the second floor. While conventional nails and fasteners may be used, care needs to be exercised that they do not bridge the thermal break between shape 16 and shape 18.

For example, in FIG. 1, the base support angle 23 and top support angle 23B would create thermal shorts when placed at the end points of stud 10, if not for notching 30A of bar 30 or leg 34 of tee shape 18. FIG. 1 also shows thermal break 27 (wood plate or foam insulation) between stud 10 and floor 26. Thermal break 27 also is shown between stud 10 and truss 28 and ceiling 24. While notch 30A is preferred, thermal break 27 may be used in place of notch 30A or in combination with notch 30A.

Figure 1A:
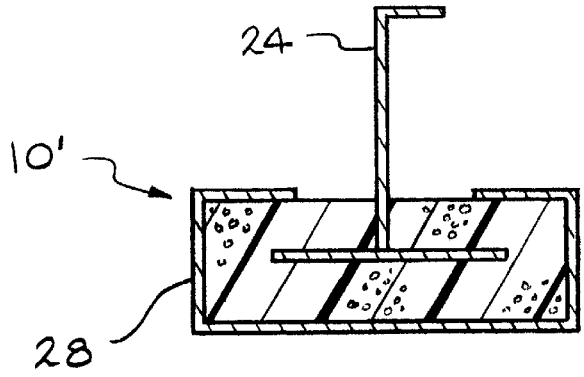
FIG. 1A is a cross-sectional view of the bottom truss chord of FIG. 1 taken along line 1A—1A.

FIG. 1A shows bottom roof truss chord 10' separated into T-shape 24 and C-shape 28 to create a thermal break. FIG. 1A is a cross-sectional view taken along line 1A—1A.

Figure 1B:
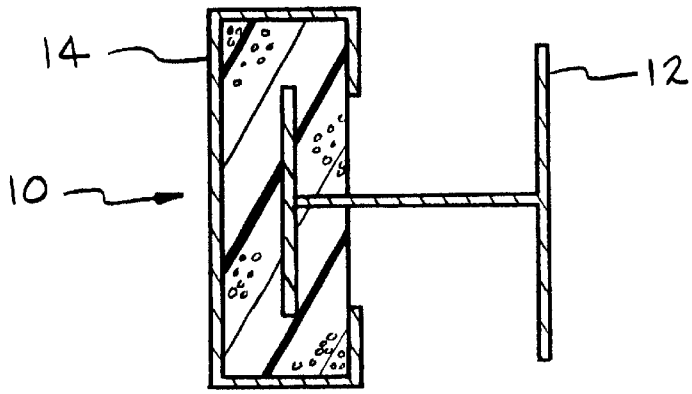
FIG. 1B is a cross-sectional view of the stud of FIG. 1 taken along line 1B—1B.

FIG. 1B is a cross-sectional view of stud 10 taken along line 1B—1B.

Figure 1C:
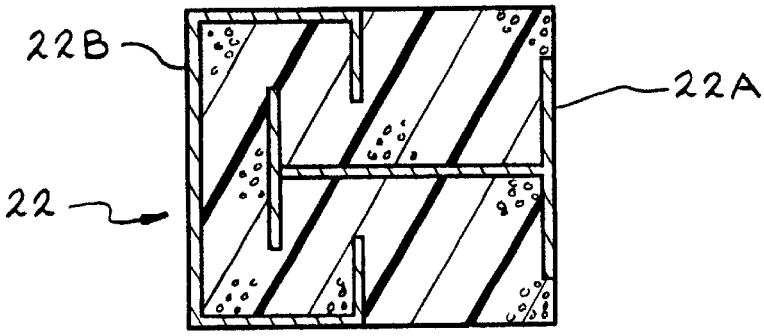
FIG. 1C is a cross-sectional view of the floor joist taken of FIG. 1 taken along line 1C—1C.

FIG. 1C shows floor joists 22 taken along line 1C—1C.

FIG. 2 shows the preferred embodiment of stud 10 with inner shape 18 in the form of a T and outer shape 16 in the form of a C. C-shape 16 circumscribes or houses, but does not touch cross bar 30 of T-shape 18. Foot 32 may be fastened to leg 34 of T-shape 18. Foot 32 then fastens to outside wall 12 and backbone 36 of C-shape 16 fastens to inside wall 14.

Figure 3:
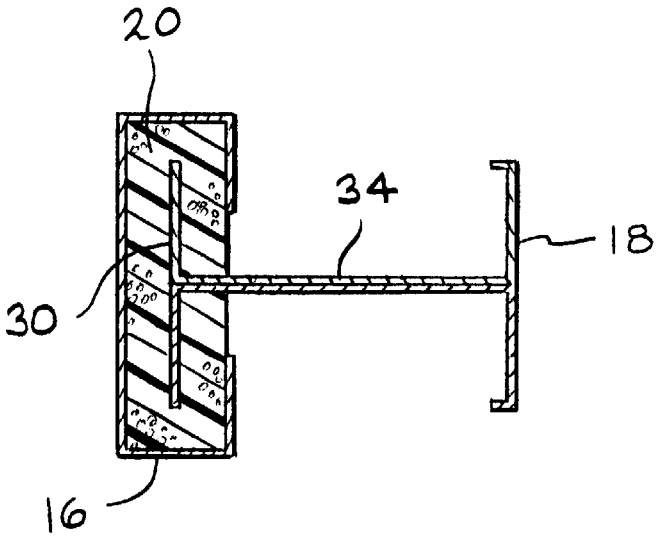
FIG. 3 is a cross-sectional view of FIG. 2.

FIG. 3 is a cross-sectional view of FIG. 2. This shows the substantial spacing between T-shape 18 and C-shape 16. Insulating material 20 fills the spacing.

Figure 4:
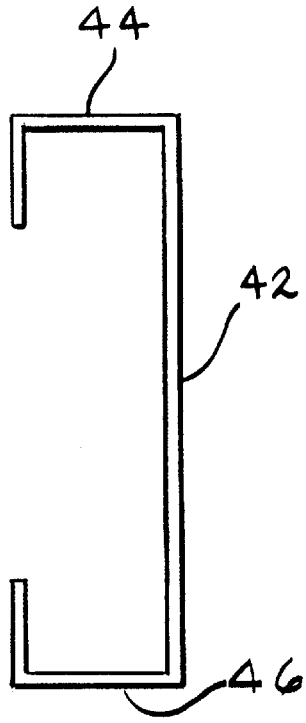
FIG. 4 PRIOR ART
FIG. 4 is a cross-sectional view of a prior art metal stud.

FIG. 4 shows a prior art C-shaped steel stud 40. As one can see, no thermal break exists. Backbone 42 provides a direct thermal short from leg 44 to leg 46. Legs 44 and 46 fasten to the inner and outer walls of a building respectively.

The metallic portions of stud 10; e.g., outer shape 16 and inner shape 18, may comprise any metal. Preferably, the metal is hot dipped galvanized strip steel having a generally common thickness throughout and of a specific thickness gauge such as from 16 to 27 as prescribed by A.I.S.I. Metallic stud 10 generally is equivalent to a "2×6" in wood vernacular.

Figure 5:
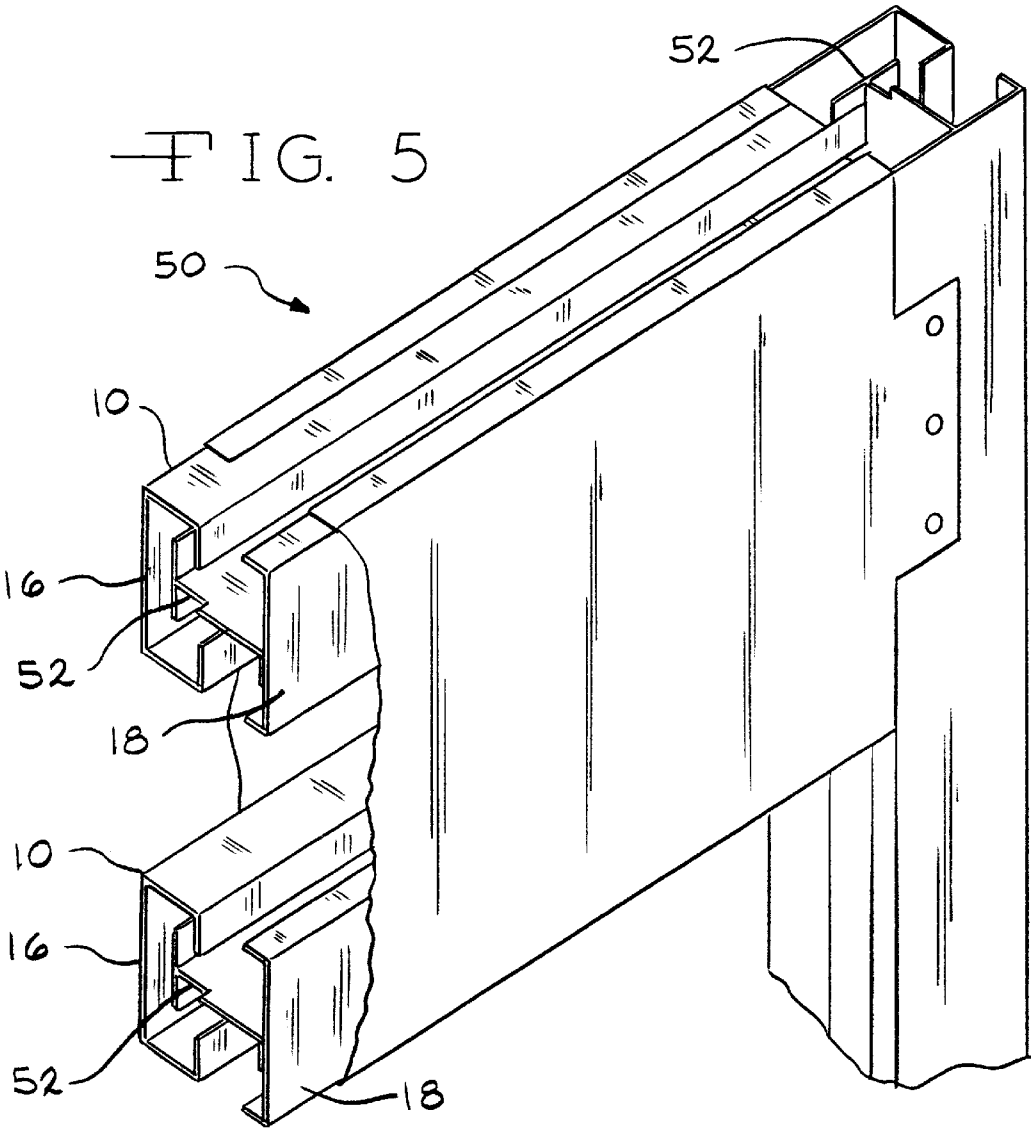
FIG. 5 shows the composite member used in a door or window header.

FIG. 5 shows stud 10 with outer shape 16 and inner shape 18 forming a door or window header 50. Note, notches 52. In this concept, the end points of the studs are recessed or notched to eliminate the thermal short that would exist from butting up to a solid steel plate. This saves a lot of isolation blocks and material. This particular break is preferred. Practical considerations of construction and fabrication, however, may force the use of blocking insulation rather than notching.

Insulating material 20 may be any thermal insulation. Spacing between inner shape 16 and outer shape 18 is generous. Preferably, the spacing provides a cavity with a thickness of at least ½ inch and ranging up to 1 inch. Therefore, insulation boards will provide higher R-values than loose fill or fibrous insulation. Preferably, insulation boards of polyurethane or polystyrene foam fill cavity 20. Density of polyurethane foam varies from 2 to 50 $lb/ft^3$. Polyurethane foam one inch in thickness and having a density of 1.75 $lb/ft^3$ has an R-value of 4.7 to 7.0. Extruded polystyrene one inch in thickness has a density of 1.6 to 3 $lb/ft^3$ and R-Value of 5.

Glue, nails, screws, other insulative materials and the like may be in the structure to mount or secure devices such as electrical wire and electrical boxes. Care, however, must be taken not to bridge cavity 20 and create a thermal short.

Other embodiments include maintaining convenient cutouts and aligning the cutouts with the inner steel shapes and outer steel shapes to provide for perpendicular conduits through the composite steel members. Still others include sound dampening residential walls using the insulated stud.

In addition to the embodiments discussed above, it will be clear to persons skilled in the art that numerous modifications and changes can be made to the above invention without departing from its intended spirit and scope.

I claim:

1. A composite structural building stud comprising an inner metal shape and an outer metal shape with a thermal break between the inner shape and the outer shape wherein the inner shape is not in contact with the outer shape and wherein the inner and outer shape define a multifaceted cavity therebetween and including a thermal insulating material filling the cavity wherein the composite stud has a strength and R-value of a comparable wood stud;

wherein the composite stud has acoustical properties better than a standard wood or steel stud;

wherein the inner and outer shape have an interlocking shape which holds the insulating material in compression;

wherein the compression of the insulating material couples the inner and outer shape together, and wherein the outer shape circumscribes or houses the inner shape.

2. A composite stud according to claim 1, wherein the acoustical properties are sound dampening properties.

3. A composite stud according to claim 1, wherein the insulating material is a self-setting foam that naturally adheres to the inner and outer shapes.

4. A composite stud according to claim 1, including an adhesive to bond the insulating material to the inner and outer shapes.

5. A composite stud according to claim 1, wherein the insulating material has a thickness of at least ½ inch and an R-value of at least 2.5.

6. A composite stud according to claim 1, wherein the insulating material has a thickness ranging from ½ inch to 1 inch and an R-value of at least an R-Value of 2.5 to 7.

7. A composite stud according to claim 1, wherein the insulating material is a polyurethane or polystyrene foam.

8. A composite stud according to claim 1, wherein the inner shape is a T-shape and the outer shape is a C-shape.

9. A composite according to claim 8 wherein the T-shape has a cross bar and the C-shape encompasses the cross bar with a thermal break between the C-shape and the cross-bar.

10. A composite stud according to claim 9 wherein the T-shape includes a leg connected to the cross-bar and a portion of the leg adjacent the cross-bar is notched.

11. A composite stud according to claim 1, wherein the metal shapes are made of steel.

12. A composite stud according to claim 1, wherein the metal shapes are made of galvanized steel.

13. A composite stud according to claim 1 wherein the metal shapes and made of stainless steel.

14. A composite stud according to claim 1 wherein the metal shapes are made of aluminum.

15. A composite stud according to claim 1 wherein at least one of the inner and outer shape include a notch providing an additional thermal break.

16. A bottom truss chord including the composite stud of claim 1.

17. A floor joist including the composite stud of claim 1.

18. A structure comprising the composite stud of claim 1, a bottom truss chord or a floor joist and a thermal insulating material between the composite stud and the truss chord on the floor joist.

19. A structure according to claim 18 wherein the composite stud includes a notch adjacent the truss chord or floor joist, wherein the notch is a thermal break.

20. A door or window header comprising at least one composite structure according to claim 1.

21. A door or window header according to claim 20 including a notch in the composite stud, wherein the notch is a thermal break.

22. A composite stud according to claim 1 having a higher sound transmission loss than a standard wood or steel stud.

23. A composite structural building stud comprising an inner metal shape and an outer metal shape with a thermal break between the inner shape and the outer shape wherein the inner shape is not in contact with the outer shape and wherein the inner and outer shape define a multifaceted cavity therebetween and including a thermal insulating material filling the cavity wherein the composite stud has a strength and R-value of a comparable wood stud;

wherein the composite stud has acoustical properties better than a standard wood or steel stud;

wherein the inner and outer shape have an interlocking shape which holds the insulating material in compression;

wherein the compression of the insulating material couples the inner and outer shape together; and wherein the outer shape encompasses the inner shape.

24. A structure comprising:

(a) a bottom truss chord including a composite structural building stud comprising an inner metal shape and an outer metal shape with a thermal break between the inner shape and the outer shape wherein the inner shape is not in contact with the outer shape and wherein the inner and outer shape define a multifaceted cavity therebetween and including a thermal insulating material filling the cavity wherein the composite stud has a strength and R-value of a comparable wood stud;

wherein the composite stud has acoustical properties better than a standard wood or steel stud;

wherein the inner and outer shape have an interlocking shape which holds the insulating material in compression; and wherein the compression of the insulating material couples the inner and outer shape together;

(b) a composite structural building stud comprising an inner metal shape and an outer metal shape with a thermal break between the inner shape and the outer shape wherein the inner shape is not in contact with the outer shape and wherein the inner shape is not in contact with the outer shape and wherein the inner and outer shape define a multifaceted cavity therebetween and including a thermal insulating material filling the cavity wherein the composite stud has a strength and R-value of a comparable wood stud;

wherein the composite stud has acoustical properties better than a standard wood or steel stud;

wherein the inner and outer shape have an interlocking shape which holds the insulating material in compression; and wherein the compression of the insulating material couples the inner and outer shape together, and (c) a notched steel box connected therebetween wherein the notch is a thermal break between the bottom truss chord of (a) and the composite stud of (b).

25. A structure comprising a floor joist including a composite structural building stud comprising an inner metal shape and an outer metal shape with a thermal break between the inner shape and the outer shape wherein the inner shape is not in contact with the outer shape and wherein the inner and outer shape define a multifaceted cavity therebetween and including a thermal insulating material filling the cavity wherein the composite stud has a strength and R-value of a comparable wood stud;

wherein the composite stud has acoustical properties better than a standard wood or steel stud;

wherein the inner and outer shape have an interlocking shape which holds the insulating material inn compression; and wherein the compression of the insulating material couples the inner and outer shape together, a foundation and a notched steel box connected therebetween, wherein the notch is a thermal break between the floor joist and the foundation.

* * * * *